United States Patent [19]

Nakamura et al.

[11] 4,106,553

[45] Aug. 15, 1978

[54] SEALING DEVICE FOR A ROTARY REGENERATIVE HEAT EXCHANGER

[75] Inventors: Kenya Nakamura, Okazaki; Hiroshi Okano, Susono, both of Japan

[73] Assignee: Toyota Jidosha Kogyo Kabushiki Kaisha, Japan

[21] Appl. No.: 715,249

[22] Filed: Aug. 17, 1976

[30] Foreign Application Priority Data

Apr. 26, 1976 [JP] Japan ..... 51-46661

[51] Int. Cl.[2] ..... F28D 19/00

[52] U.S. Cl. ..... 165/9; 277/83; 277/88; 267/165

[58] Field of Search ..... 165/8, 9; 277/83, 88

[56] References Cited

U.S. PATENT DOCUMENTS

| | | | |
|---|---|---|---|
| 2,852,234 | 9/1958 | Mudersbach | 165/9 |
| 2,873,952 | 2/1959 | Mudersbach et al. | 165/9 |
| 3,010,703 | 11/1961 | Bellows et al. | 165/9 |
| 3,372,735 | 3/1968 | Meijer | 165/9 |

FOREIGN PATENT DOCUMENTS

| | | | |
|---|---|---|---|
| 850,738 | 10/1960 | United Kingdom | 165/9 |

*Primary Examiner*—Albert W. Davis, Jr.
*Attorney, Agent, or Firm*—Toren, McGeady and Stanger

[57] ABSTRACT

A sealing device for a rotary regenerative heat exchanger is provided with a pair of flat, rigid seal ring portions positioned on opposite sides of a rotary type regenerating body, with a minute clearance maintained between the seal ring portions and the peripheral edge portions of the regenerating body, and with at least a pair of cross bar portions extending crosswise past each center of the seal ring portions from one position on the peripheral edge portion of each seal ring portion to another symmetrically opposite position on the same peripheral edge portion of the seal ring portion. The cross bar portions are also spaced a minute clearance from the side surfaces of the regenerating body, the clearances being so predetermined as to effectively seal fluids tending to pass therethrough. The sealing device also provides a spacer ring sandwiched between the opposed seal ring portions as well as a center spacer shaft sandwiched between opposed central portions of the cross bar portions. The cross bar portions have flexibility which may accomodate their contours to possible deformations in the central portion of the regenerating body, and measures are provided to impart such flexibility. Unlike prior structure, the seal ring portions and cross bar portions are not urged against nor are they in contact with the side surfaces of the regenerating body but they are spaced a minute clearance therefrom thereby avoiding wear and fluid-leakage problems.

9 Claims, 11 Drawing Figures

SEALING DEVICE FOR A ROTARY REGENERATIVE HEAT EXCHANGER

BACKGROUND OF THE INVENTION

The present invention relates to improvements in a sealing device for use in a rotary type regenerative heat exchanger, and more particularly to a sealing device exhibiting improved wear and fluid-leakage characteristics.

In devices of the type to which the present invention relates, there is normally provided a rotary regenerative heat exchanger body which is generally in the form of a disc rotating slowly about a central axis. A multiplicity of axially extending flow passages are provided through which heat exchange media flows to effect the heat exchange functions of the device.

Since the flow of the heat exchange media through the axial flow passages must be properly directed and separated, means are provided for defining separate flow channels to and from the rotary generative heat exchange body. Naturally, seals must be provided between the rotary regenerative body and the flow channel defining means, and such seals are normally structured to be in sliding engagement with the rotating regenerative body.

As a result, certain problems may arise causing wear and leakage in the heat exchanger. Deformations may occur in the sliding seals and if the seals are urged against the regenerative body with excessive force, wear tends to increase thereby shortening the service life of the heat exchanger. Furthermore, accompanying leakage problems will tend to reduce overall efficiency.

The present invention is directed to avoiding shortcomings arising with prior art rotary type regenerative heat exchangers.

It is a principal object of the present invention to provide a sealing device for use in a rotary type regenerative heat exchanger which reduces wear problems arising in seals for rotary regenerative heat exchangers.

It is another object of the present invention to provide a sealing device for use in a rotary type regenerative heat exchanger wherein sealing materials are utilized that may accommodate their contours to deformations i.e., build-up or depression in the center portions of a regenerating body during its operation, while maintaining a predetermined clearance between the sealing members and the side surfaces of the regenerating body.

SUMMARY OF THE INVENTION

According to the first aspect of the present invention, there is provided a sealing device for use in a rotary type regenerative heat exchanger which includes flat, rigid seal ring portions having opposed flat surfaces which are adapted to face the outer peripheral edge portions of a regenerating body, and cross bar portions extending crosswise past each center of the seal ring portions from one position on the peripheral edge portions of each seal ring portion to another symmetrically opposite position on the same peripheral edge portion of the seal ring portion. Unlike sealing devices of the prior art, the sealing materials or seal ring portions and cross bar portions of the invention are not urged against nor are they in contact with the side surfaces of the regenerating body but they are spaced a minute clearance on the order of 10 microns therefrom. In addition, the cross bar portions are provided with flexibility that may well accommodate their contours to thermal deformations in the central portions of the regenerating body. Thus, the desired predetermined clearance may be maintained between the side surfaces of the regenerating body and both the sealing ring and cross bar portions. Although even such a minute clearance can not eliminate leakage of fluid completely, the amount of fluid being leaked therethrough is extremely small.

The aforesaid clearances are maintained by spacer means provided between the peripheral edge portions and central portions of the regenerating body and the sealing device. In addition, absence of contact between the sealing members and the side surfaces not including peripheral edge and central portions of the regenerating body insures an extended service life of the heat exchanger, because wear and fluid-leakage problems are minimized, thereby improving the service life of an engine. Also, no springs and no air pressure are used in high-temperature areas of the exchanger, eliminating yielding problems with regard to springs, seals, and regenerating body.

In the present invention, the rotating regenerating body itself can not avoid being biasing towards stationary parts, due to the load or frictional resistance of the fluid passing through the regenerating body. However, such force tending to urge the regenerating body to one side is extremely small in devices according to the invention as compared with forces arising in prior art devices. Thus, the power required to rotate the regenerating body may be reduced to a large extent, with accompanying improvements in the efficiency of driving the regenerating body.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENTS

Figure 1:
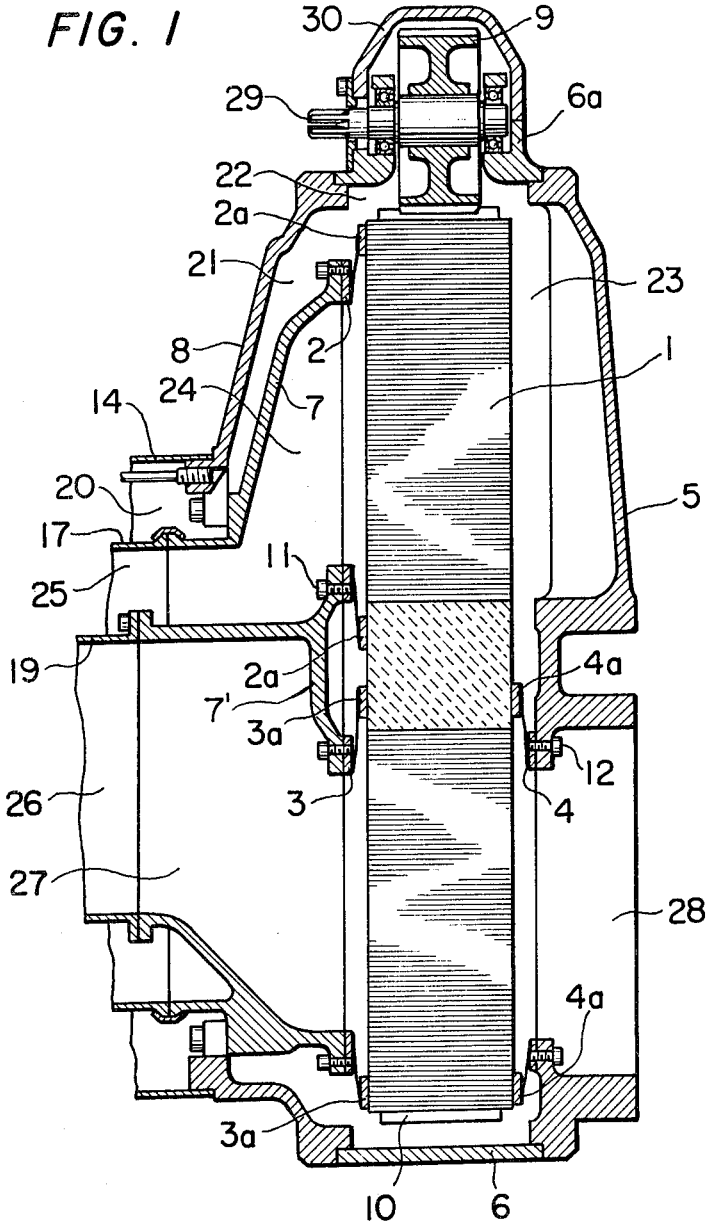
FIG. 1 is a longitudinal cross-sectional view of a prior art rotary type regenerative heat exchanger.

Referring now to the drawings, wherein like reference characters are utilized to refer to similar parts throughout the various figures thereof, the structural details of the present invention will be described by referring first to a typical rotary type regenerative heat exchanger which is depicted in FIG. 1. The regenerative heat exchanger depicted in FIG. 1 comprises a regenerating body 1 in the form of a thick disc which has a plurality of small through-holes extending in the axial direction thereof. Fitted on the outer periphery of the regenerating body 1 is a toothed ring 10. The regenerating body 1 thus constructed is rotatably supported within covers 5, 6, 8 and 30. The cover 6 is of a substantially cylindrical form with several openings 6*a* provided on its peripheral surface, and with driven gear mechanisms housed therein which mesh with the toothed outer periphery of the regenerating body 1. The gear mechanisms have drive gears 9, at least one of which is mounted on a drive shaft 29, so that the regenerating body 1 may be rotated at a low R.P.M. through the medium of the drive shaft 29 and drive gears 9 by means of a drive source (not shown).

The heat exchanger is communicated with a gas turbine engine (not shown) through a concentric cylindrical engine housing 14, an inner cylindrical housing 17 and a turbine exit housing 19. The housings 14, 17 and 19 define spaces 20, 25, 26 therebetween, through which a working fluid flows for heat exchange. In this respect, bellows 2, 3 and 4 positioned between the rotating regenerating body 1 and the stationary inner cover 7 are fastened to the inner cover 7, partition wall or inner housing 7' and cover 5 by means of bolts 11, 12 and the like. The bellows 2, 3, 4 are formed with sliding members 2*a*, 3*a*, 4*a* which slide on the side surfaces of the regenerating body 1, while the sliding members 2*a*, 3*a*, 4*a* themselves remain stationary, thereby effecting a fluid seal.

In operation, pressurized air continuously flows from an engine compressor through spaces 20, 21, 22 into a space 23, and then through a plurality of small through-holes in the regenerating body 1 into a space 24, during which air is heated by means of the regenerating body 1. The air thus heated flows as a high-temperature and high-pressure fluid through a space 25 into an engine combustion chamber. On the other hand, a high-temperature-low-pressure fluid which is being exhausted from a turbine rotor flows into a space 26 defined by the housing 19 therein, then into a space 27 defined by the inner housing 7' through a plurality of small through-holes in the regenerating body 1 into an exhaust passage 28, during which the fluid heats the regenerating body 1. The fluid which has entered the exhaust passage 28 is then exhausted through an exhaust pipe to the atmosphere.

As described earlier, bellows provided between the rotating regenerating body and stationary ducts or housings have sliding members of the bellows maintained in contact with the side surfaces of the regenerating body. The sliding members are urged against the side surfaces of the regenerating body, due to a pressure difference in a working fluid and by means of springs, so as to prevent fluid leakage and to seal fluid flow. However, the prior art sealing device of the type described suffers from disadvantages in that the sliding members should accommodate themselves to deformations, i.e., build-up or depression which takes place in the central portion of the regenerating body during operation (See FIG. 1*a*). To this end, the sliding members are urged against the side surfaces of the regenerating body by an excessively large force, thereby accelerating wear on both the regenerating body and the sliding members, resulting in a short service life of the heat exchanger. Additionally, the sliding members on a high temperature side of the fluid tend to be thermally deformed, thereby resulting in an unwanted large clearance or gap between the sliding members and the side surfaces of the regenerating body, with an accompanying leakage of fluid and hence lowering in the output of an engine. Furthermore, even if springs on the high temperature side of the regenerating body are made of a high-grade material, the springs are liable to display yield characteristics causing difficulty in the control of a load to be imposed on the sliding members. Thus, pressures of the sliding members applied to the side surfaces of the regenerating body cannot be maintained uniform.

Figure 2:
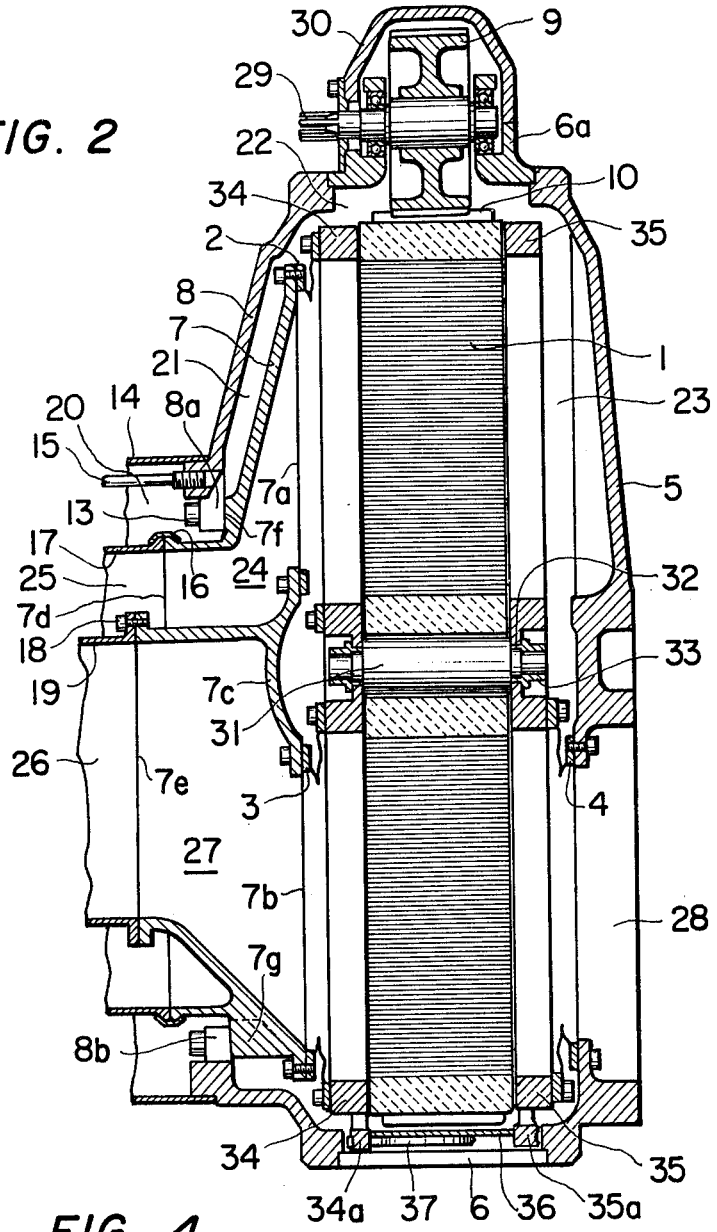
FIG. 2 is a longitudinal cross-sectional view of a rotary type regenerative heat exchanger according to the present invention.

Referring now to FIG. 2, wherein an embodiment of the present invention is depicted, an engine housing 14, an inner cylindrical housing 17 and a turbine exit housing 19 are provided with a concentric cylindrical shape. The engine housing 14 is secured in air tight engagement to a cover 8 of a regenerating body 1 by means of a plurality of bolts 15. The cover 8 is formed with a plurality of arms 8*a*, 8*b* which extend inwardly and are secured to bosses 7*f*, 7*g* of the inner cover 7 by means of bolts 13. A space 20 defined between the engine housing and the inner cylindrical housing 17 and a space 21 defined between the cover 8 and the inner cover 7 are communicated each other. The inner cylindrical housing 17 is coupled to a combustion chamber of an engine and secured to the inner cover 7 for a heat exchanger, by means of a band 16 covering a joint between the housing 17 and the cover 7. The turbine exit housing 19 is secured to the cylindrical portion of the inner cover 7 by means of bolts 18. The cylindrical portion of the inner cover 7 is formed with two openings 7*a*, 7*b* which from complementary parts of a circular area, respectively. In other words, the opening 7*a* forms part of a circular area, while the opening 7*b* forms the other part of the circular area, as viewed from the right. Defined between the two openings 7*a*, and 7*b* is a partition wall 7*c*. There are provided concentric circular openings 7*d* and 7*e*, as the inner cover 7 is viewed from the left, while the opening 7*d* is communicated with the opening 7*a*, and the opening 7*e* with the opening 7*b*. Spaces 24, 27 are both partitioned by a wall. As previously indicated, the inner cover 7 is fastened to the cover 8 by means of bolts 13. A cover 6 is sandwiched between the cover 8 and a cover 5, being fastened thereto by means of bolts and nuts (not shown). The shape of the cover 6 in its entire view is cylindrical, while the cover 6 is formed with a plurality of boss portions 6*a* on its outer peripheral surface for housing drive mechanisms adapted to rotate the regenerating body 1 and supporting mechanisms therefor. One of the boss portions 6*a* is shown, housing a drive shaft 29 and a drive gear 9 therein, so that the regenerating body 1 may be rotated at a low R.P.M. The regenerating body 1 is of a flat disc form, with a plurality of small through-holes extending therethrough in the axial direction thereof. Fitted on the periphery of the regenerating body 1 is a toothed ring 10, which meshes with a plurality of drive gears 9 centering the ring 10.

The arrangement described thus far is generally similar to prior art heat exchangers. As will be seen from the description which follows, the features of the present invention relate to improvements in the sealing device.

Figure 3:
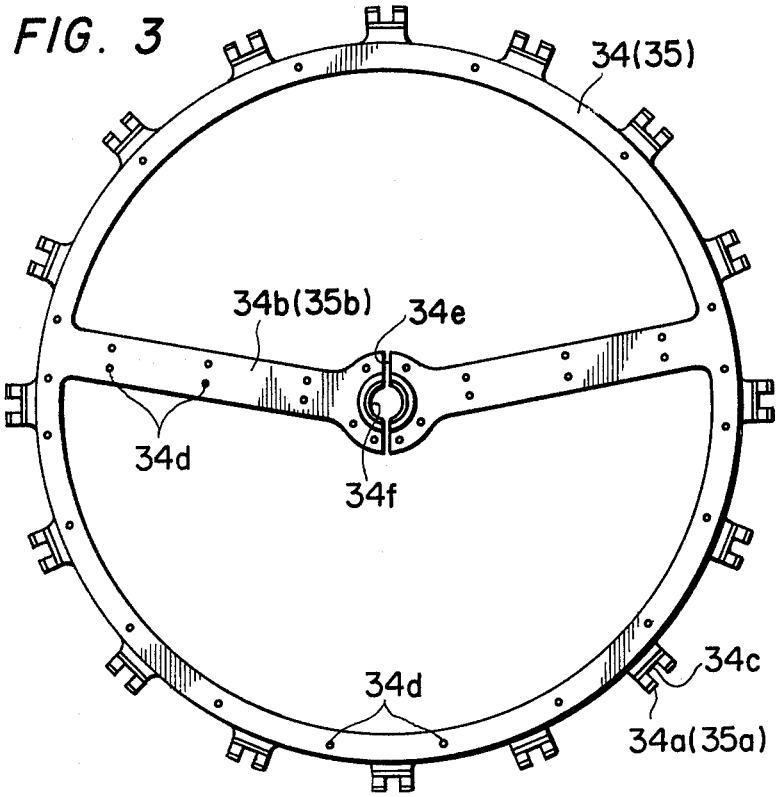
FIG. 3 is a plan view of a seal ring portion and a cross bar portion of the sealing device according to the present invention.

The sealing device according to the present invention includes a pair of flat, rigid seal ring portions 34, 35 which are positioned on opposite sides of the regenerating body 1, with a minute clearance on the order of several tens microns maintained between the side surface of the peripheral edge portions of the regenerating body 1 and portions 34, 35, respectively. The sealing device further includes cross bar portions **34*b*, 35*b* which extend crosswise of the corresponding seal ring portions past each center thereof from one position on the peripheral edge of each seal ring portion to another symmetrically opposite position on the same peripheral edge portion of the seal ring portion. In FIG. 3, there are shown seal ring portion 34 and cross bar portion 34*b*, which may be described similarly to the seal ring portion 35 and cross bar portion 35*b*. The cross bar portions 34*b* and 35*b* are also spaced a minute clearance from the side surfaces of the regenerating body 1**, respectively.

The aforesaid minute clearances for the sealing ring portions and cross bar portions of the sealing device will effectively seal a fluid tending to pass therethrough. These clearances may be maintained to a predetermined value with the aid of spacer means which will be described in more detail hereinafter.

As is clear from FIGS. 2 and 3, a plurality of projecting arms **34*a*, 35*a* are formed on the outer peripheral surfaces of the sealing ring portions 34, 35, while the arms 34*a*, 35*a* are formed with recesses 34*c*, respectively, which are open radially outwardly. The bottoms of the recesses 34*c* are flat, in parallel with the axis of the seal ring portions, and spaced a given distance from the center of the seal ring portions. Defined in the central portion of the bottom surfaces of recesses 34*c* are threaded holes which do not extend through the projecting arms 34*a*, 35*a* in a radial direction. Screws 39 which will be described hereinafter are threaded into the aforesaid thereaded holes, thereby securing plates 38 to the top surfaces of the arms 34*a*, 35*a*. Defined at a suitable spacing in the seal ring portion 34 and cross bar portion 34*b* are threaded holes 34*d* which do not extend through the portions 34, 34*b* and which secure bellows 2, 3 and 4 in position. Confined between the opposite, projecting arms 34*a* and 35*a* of the seal ring portions 34 and 35 is a cylindrical spacer ring 36, with a spring 37 being secured to the arms 34*a*, 35*a* formed on the opposite seal ring portions 34, 35 so as to pull the seal ring portions together, with the spacer ring 36 sandwiched therebetween. The axial length of the spacer ring 36 is slightly larger than the length of the regenerating body 1, so that predetermined minute clearances may be maintained between the seal ring portions and the regenerating body 1. Meanwhile, openings are provided in the spacer ring 36 in the positions in coincidence with the openings 6*a* in the cover 6, so that drive gear mechanisms mesh with the toothed ring 10 through the aforesaid openings which are in register with each other. The surfaces of the seal ring portions 34, 35 and the opposed surfaces of the regenerating body 1 are smoothly finished. In this respect, the aforesaid surfaces of the seal ring portions 34, 35** may be faced or coated with an anti-abrasion material, as required.

A circular hole **34*f*, as shown in FIG. 3, is provided in the center of cross bar portion 34*b*, and a slit 34*e* is also provided in the central portion of the cross bar portion 34*b* in a direction at a right angle to the direction of thermal expansion which may occur in the cross bar portion 34*b*. The slit 34*e* is intended to provide desired flexibility to the cross bar portion 34*b* as well as to provide for thermal expansion thereof. A spacer shaft 31 is fitted in the hole defined in the aforesaid central portion of the cross bar portion 34*b*, with spacers 32 interposed between the end faces of the spacer shaft 31 and nuts 33 which fasten the cross bar portions 34*b* to the spacer shaft 31, respectively. The diameter of the spacer shaft 31 is slightly smaller than that of a center through-hole in the regenerating body 1, so that the spacer shaft 31 is compatible with centering of the regenerating body 1 by means of the aforesaid plurality of gears 9. In other words, the spacer shaft 31 is spaced a minute clearance from the wall of the aforementioned center through-hole. The length of the spacer shaft 31 is the same in dimension as the width of the spacer ring 36, i.e., slightly larger than the axial width of the regenerating body 1, so that the cross bar portions may be spaced a minute clearance from the side surfaces of the regenerating body 1, respectively. The thickness of the spacer 32 is slightly larger than the thickness of the central portion of the cross bar portion 34*b*, so that even if the nut 33 is tightened, the regenerating body 1 may be freely rotated and in addition the cross bar portion 34*b*** may expand freely along its length.

Figure 4:
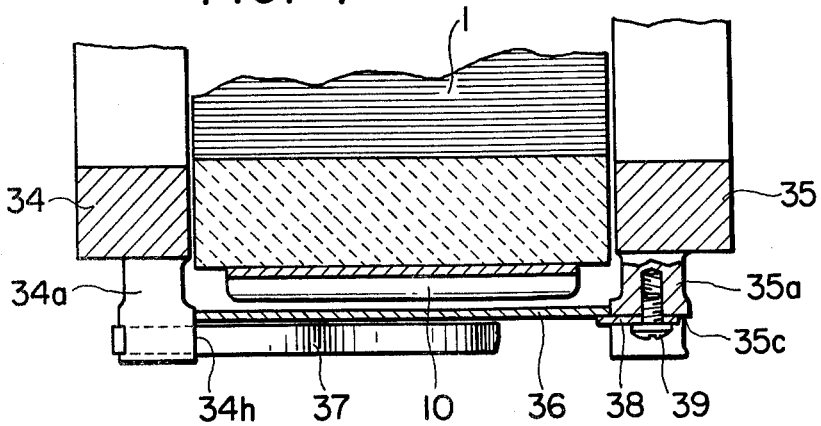
FIG. 4 is a cross-sectional view of peripheral edge portions of a regenerating body and seal ring portions which are positioned on the opposite sides of a regenerating body.
Figure 5:
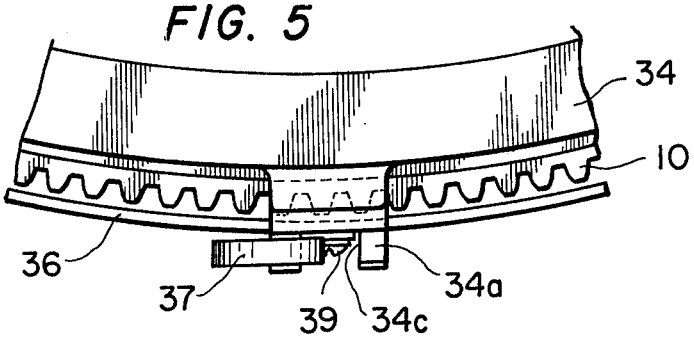
FIG. 5 is a side view of a toothed ring fitted on the periphery of a regenerating body and part of a seal ring portion.
Figure 6:
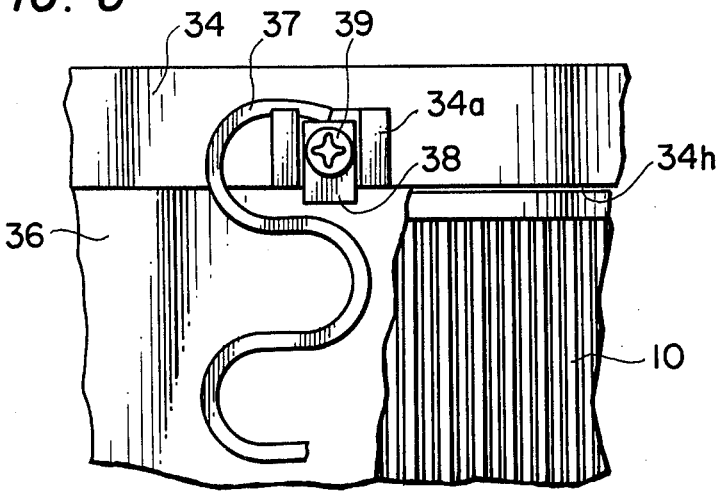
FIG. 6 is a plan view of part of a seal ring portion, spring and regenerating body.

FIGS. 4, 5, 6 show the relationship of the seal ring portions 34, 35 to the spacer ring 36. As shown, the projecting arms **34*a*, and 35*a* formed on the seal ring portions 34, 35 are positioned opposite to each other, with the spacer ring of a predetermined width being sandwiched between the arms 34*a* and 35*a*. In this respect, plates 38 are secured to the recessed portion 35*c* in the projecting area 35*a* by means of screws 39, thereby supporting the spacer ring 36 in position, while a spring 37 is removably secured to the projecting arms 34*a* and 35*a*** at its opposite ends, respectively, thereby providing a force to the seal ring portions for squeezing the spacer ring therewith.

The operation of a heat exchanger according to the present invention is identical to that of a prior art heat exchanger, except for the fluid sealing construction. More particularly, pressurized air from a compressor flows through the space 20 into spaces 21, 22, 23, then through the regenerating body 1, from which heat is conducted to the pressurized air, then into the spaces 24, 25 towards a combustion chamber (not shown). On the other hand, a high-temperature-low-pressure gas flows from a turbine (not shown), then through spaces 26, 27 and regenerating body 1, where heat is conducted to the regenerating body 1, then through an exhaust opening 28 and an exhaust pipe (not shown) to the atmosphere.

As has been described earlier, unlike the prior art sealing device, the seal ring portions 34, 35 and cross bar portions **34*b* and 35*b* of the sealing device according to the present invention are not urged against nor are they in contact with the side surfaces of the regenerating body 1. Instead they are spaced a minute clearance on the order of several tens microns therefrom respectively. The aforesaid minute clearance has proven to be capable of effectively sealing a fluid or gas tending to pass therethrough. As is apparent from the foregoing, there occurs little or no wear in the seal ring portions, cross bar portions and side surfaces of the regenerating body 1**, because of the lack of contact therebetween.

Thus, power to drive the regenerating body 1 may be conserved to a large extent because of the absence of friction between the adjacent members. It should be noted however that, in an actual application, the regenerating body 1 is supported by a plurality of gears in the radial direction rather than in the axial direction, so that frictional resistance of fluid passing through the small through-holes in the regenerating body 1 tends to bias the regenerating body 1 to either side of the seal ring portions 34 and 35. However, this urging force is negligible as compared with the force of the sliding members urged by springs against device. e.g. on the order of 1/10 thereof, and thus no wear problem takes place during the operation of a heat exchanger.

In addition, contact, if it takes place, between the sealing device and the regenerating body will be limited to between the seal ring portions and the peripheral edge portions of the regenerating body, rather than to between cross bar portions and the side surfaces of the regenerating body. This is so because if the cross bar portions contact the side surfaces of the regenerating body, they will wear faster than the seal ring portions and they will no longer be in frictional contact once they become worn. Thus, the only contact, if any, which will be maintained will be between the seal ring portions and the peripheral edge portions of the regenerating body, thereby avoiding any serious wear problem.

In this connection, thermal expansion should be taken into considerations. The regenerating body 1 is made of a nonmetallic material such as a ceramic, while the spacer ring 36 is made of a metal which provides a low coefficient of thermal expansion. In addition, the spacer ring 36 is exposed to air at a relatively low temperature on its outer peripheral surface, so that its expansion due to heat is extremely small. Accordingly, even if the regenerating body reaches its highest possible temperature, there results an increase in the clearance of only several microns. In addition, the spacer shaft 31 is also made of a material having a low coefficient of thermal expansion, so that the clearance between the cross bar portions and the side surface of the regenerating body will increase by only several microns.

Turning now to considerations of thermal expansion of the cross bar portions of the sealing device according to the present invention, the seal ring portions of the sealing device are exposed to air at a relatively low temperature, while the cross bar portions are exposed to air at a temperature several hundred centrigrade degrees higher than the former temperature. As a result, the cross bar portion expands thermally to a greater extent than the seal ring portions. However, as has been described earlier, there are provided slits **34*e*, 35*e* in the central portions of the cross bar portions for accommodating such expansion. The widths of the slits 34*e*, 35*e*** during operation of an engine will become smaller than that of the widths at room temperature. Thus, if design considerations are suitably applied to the widths of the slits and to the type of material used for the cross bar portions, then fluid leakage through the slits may be minimized. The slits provided in the central portions of the cross bar portions may effectively cope with thermal expansion of the cross bar portions.

Figure 7:
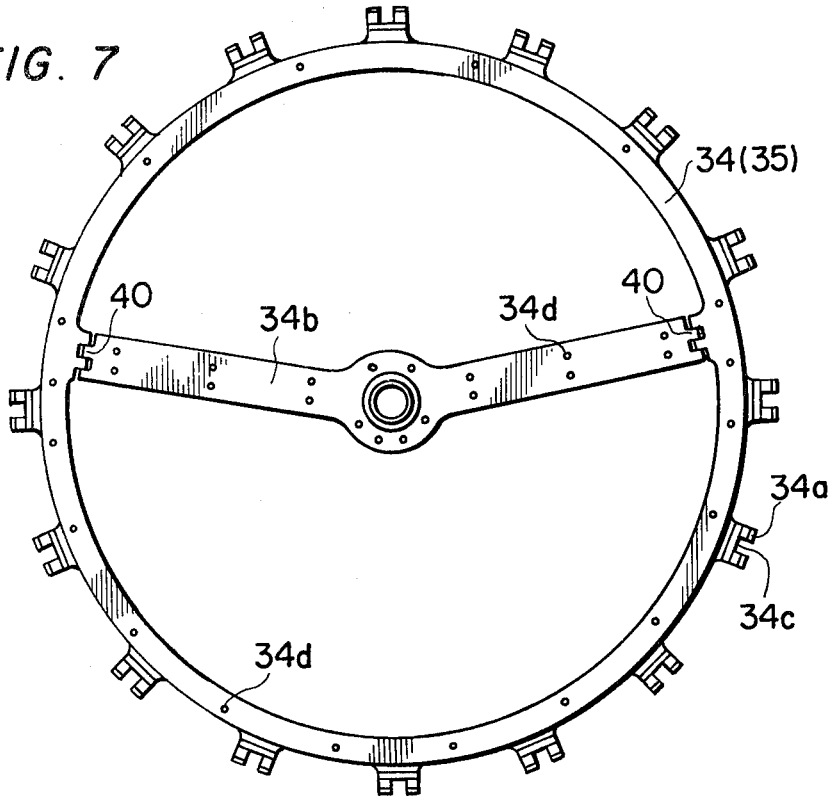
FIGS. 7, 8, 9, 10 depict different embodiments of cross bar portions according to the present invention.
Figure 8:
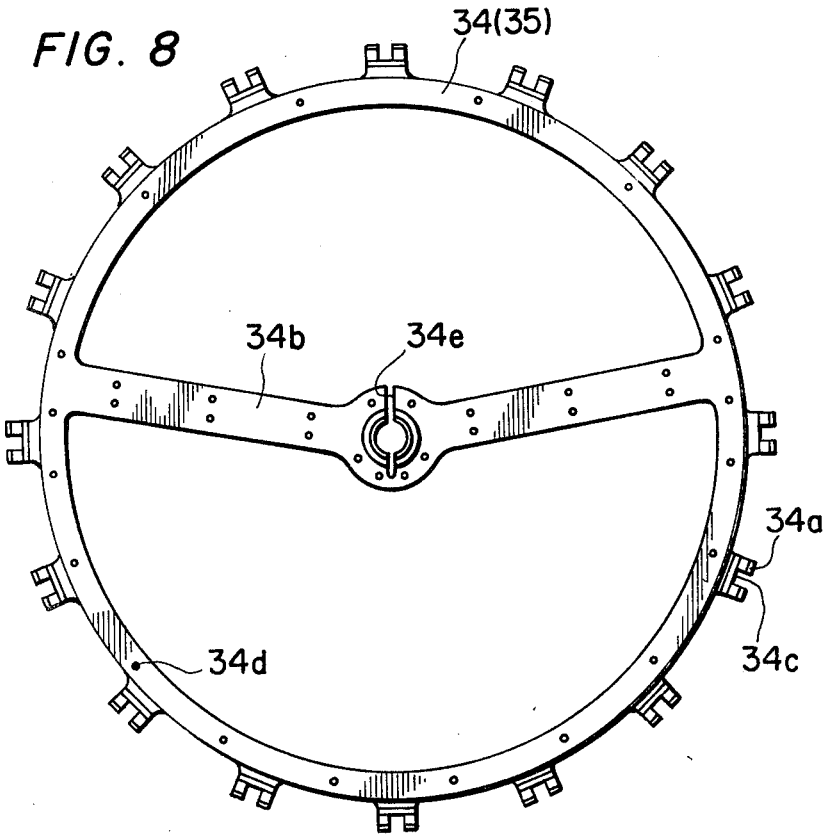

FIGS. 7 and 8 show examples derived from considerations given to thermal expansion of the cross bar protions. In FIG. 7, there is shown an arrangement wherein the engagement of the cross bar portions with the seal ring portions is effected in the form of comb-shaped engaging portions 40. In case the cross bar portions are expanded due to heat, then gaps provided in the engaging portions 40 may effectively cope with such expansion.

In addition, even if there is a lack of uniformity in temperature distribution over the surface of the cross bar portion, the flatness of the peripheral edge portion of the seal ring portion may be well maintained. The seal ring portions 34, 35 of the sealing device are exposed to air and gas at a relatively low temperature, so that the variation in temperature distribution is small. In this respect, the slits **34*e*, 35*e* in the central portions of the cross bar portions may be partially omitted as shown in FIG. 8**, as may be required.

In dealing with radial expansion of the sealing device according to the present invention, as shown in FIG. 4, the opposite ends of the spacer ring 36 simply abut the projecting arms **34*a*, being fitted in recesses provided therein, so that the seal ring portions 34 may expand radially outwardly without confinement. In addition, although the springs 37 are connected to the projecting arms on the seal ring portions 34, 35, the springs 37** may be elastically deformed, thereby avoiding interference with the radial expansion of the seal ring portions.

The seal ring portions 34, 35 are so designed as to provide widths and thicknesses which exhibit sufficient rigidity, so that little or no deformation takes place, even if a load due to a pressure difference is imposed on the seal ring portions 34, 35. In a practical application, such a deformation is on the order of several microns at the most, so that the flatness of seal ring portions may be well maintained.

Figure 9:
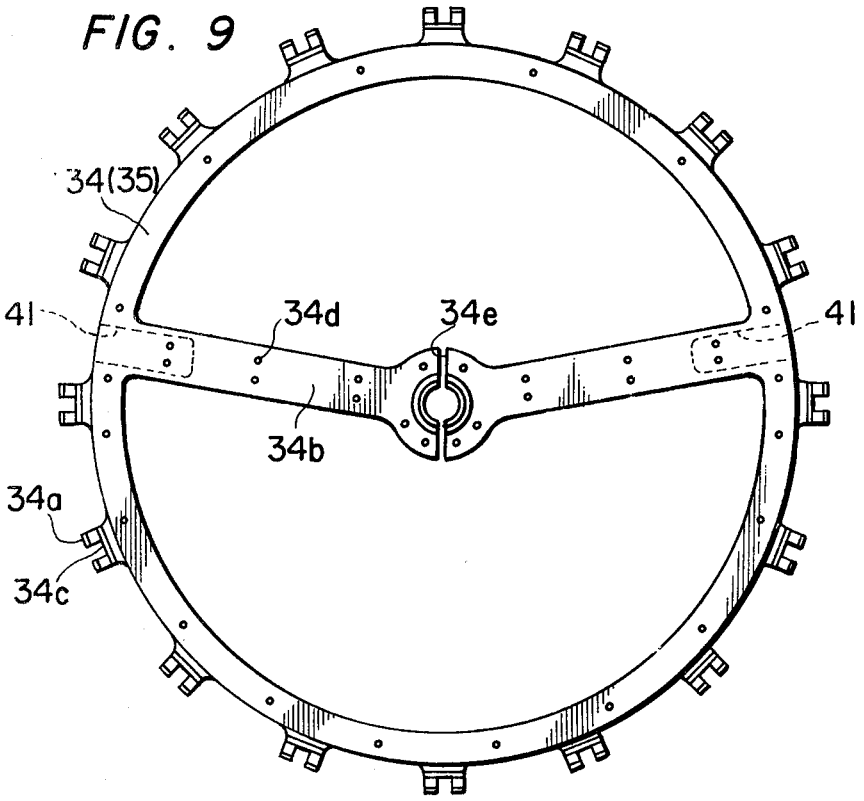

The cross bar portions are separated or discontinued in their central portions by slits or in their engaging portions from the seal ring portions, so that bending rigidity of the cross bar portions is low, and thus even if thermal deformation, or build-up or depression takes place in the side surfaces of the regenerating body 1 due to an operational condition, the cross bar portions may follow such thermal deformations. The provisions of slits **34*e* alone may well achieve this purpose but, as shown in FIG. 9, there may be additionally provided shallow recesses or reduced thickness portions 41**.

Figure 10:
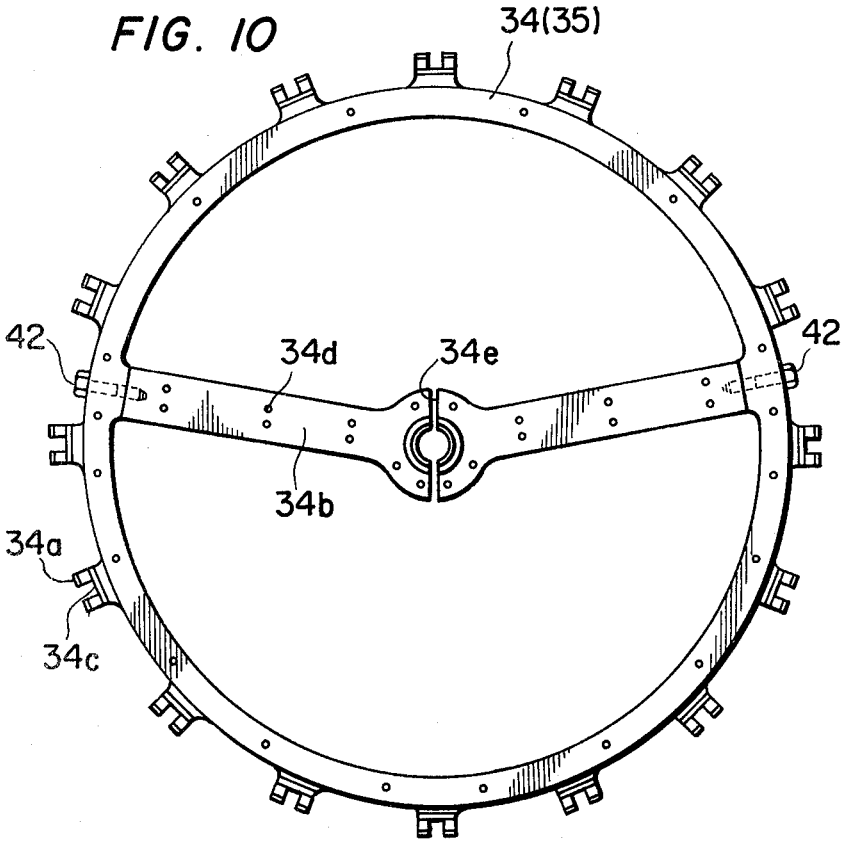

Alternatively, as shown in FIG. 10, the seal ring portions may be discontinued from the cross bar portions, and then both members may be fastened together by means of bolts 42, thereby reducing bending rigidity of the cross bar portions. Although there have been previously described embodiments in which there are provided two flow paths to be sealed by means of a single cross bar portion on one of its sides, two or more cross bar portions may be provided on one side, commensurate to the number of fluid paths, as required.

As will be apparent from the foregoing description, the seal ring portions and cross bar portions of the invention are not urged against nor are they in contact with the side surfaces of the regenerating body, but they are, instead, spaced a minute clearance distance therefrom in order to avoid wear and fluid-leakage problems. In addition, power required for driving the regenerating body may be reduced due to the absence of frictional contact between the sealing members and the regenerating body.

Figure 1A:
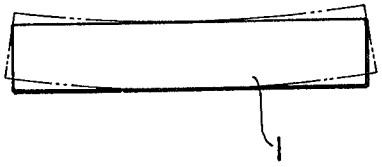
FIG. 1*a* is a schematic view depicting the deformation to which a regenerative body of a heat exchanger may be subjected during operation.

Furthermore, the cross bar portions have slits and discontinued portions providing for thermal expansion thereof, as well as shallow recessed portions or discontinued joints, so that the cross bar portions may accommodate themselves to thermal deformation, i.e., build-up or depression in the surface of a regenerating body depicted in FIG. 1*a*.

While specific embodiments of the invention have been shown and described in detail to illustrate the application of the inventive principles, it will be understood that the invention may be embodied otherwise without departing from such principles.

What is claimed is:

1. A sealing device for a rotary type regenerative heat exchanger comprising a rotary regenerative body having a pair of opposed generally planar parallel side surfaces, a pair of flat, rigid seal ring portions each positioned to extend through 360°, respectively, over said opposed surfaces on opposite sides of said rotary regenerative body, with a predetermined minute clearance spacing being maintained between each of said seal ring portions and the respective side surfaces of said regenerating body, at least a pair of cross bar portions provided one for each of said seal ring portions and extending crosswise over said opposed side surfaces of said regenerative body from one position on a peripheral edge portion of each of said seal ring portions to another symmetrically opposite position on the same peripheral edge portion of said seal ring portion, with a predetermined minute clearance spacing being maintained between each cross bar portion and the respective side surface of said regenerative body, spacer means for maintaining clearances between said side surfaces of said rotary regenerative body and said respective seal ring portions to a predetermined value, said spacer means including spring means extending about said rotary regenerative body between respective peripheral edge portions of said seal ring portions to provide support for said seal ring portions relative to said regenerative body, cover means acting both as support means for said heat exchanger and to define fluid flow passages for said regenerative body, bellows means resiliently connected between said cover means and said rigid seal ring portions to cooperate with said cover means both to assist in supporting said seal ring portions and define said fluid flow passages, and resiliency means on said cross bar portions for imparting thereto flexibility in order to accommodate possible deformations in the central portions of said regenerative body due to thermal effects.

2. A sealing device as set forth in claim 1, wherein said regenerating body has a central through-hole defined therethrough, said device further comprising a spacer shaft provided in a manner to extend through said central through-hole defined in said regenerating body, the length of said spacer shaft being slightly larger than the axial width of said regenerating body, and said spacer shaft being loosely fitted in said central through-hole.

3. A sealing device as set fotth in claim 1, wherein said cross bar portions are separated from and discontinuous to said peripheral edge portions of said seal ring portions, with fastening means being provided to fasten said cross bar portions to said peripheral edge portions.

4. A sealing device according to claim 1 wherein said spacer means further comprise a spacer ring sandwiched between opposed peripheral edge portions of said seal ring portions, said spacer ring having an axial length which is slightly larger than the axial width of said regenerative body, and a plurality of opposed projecting arms formed on the peripheries of said seal ring portions, respectively, supporting said spacer ring in sandwiched relationship therebetween.

5. A sealing device according to claim 4 wherein said spring means of said spacer means comprise springs connected to said projecting arms, respectively, to maintain said spacer ring in engagement therebetween.

6. A sealing device according to claim 1 wherein said resiliency means include slits defined in central portions of said cross bar portions respectively, said slits being arranged to extend perpendicularly to the direction of thermal expansion of said cross bar portions.

7. A sealing device as set forth in claim 6, wherein said slits extend only partially across the central portions of each of said cross bar portions.

8. A sealing device according to claim 1 wherein said resiliency means comprise engaging portions extending between said cross bar portions and said peripheral edge portions of said seal ring portions in a manner to allow relative radial displacement between said cross bar portions and said seal ring portions.

9. A sealing device according to claim 1 wherein said cross bar portions have shallow recessed portions adjacent to said peripheral edge portions of said seal ring portions, and slits defined in the central portions thereof, said slits running perpendicularly to the direction of thermal expansion of said cross bar portions.

* * * * *

UNITED STATES PATENT OFFICE

CERTIFICATE OF CORRECTION

Patent No. 4,106,553 Dated August 15, 1978

Inventor(s) Kenya Nakamura, H. Okano

It is certified that error appears in the above-identified patent and that said Letters Patent are hereby corrected as shown below:

In the heading of the Patent [75], [73] and line 8 of column 10 should read as follows:

[75] Inventors: Kenya Nakamura, Aichi-ken, Japan; Hiroshi Okano, Shizuoka-ken, Japan

[73] Assignee : Toyota Jidosha Kogyo Kabushiki Kaisha, Aichi-ken, Japan

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*